US005127856A

United States Patent [19]

Kabuto et al.

[11] Patent Number: 5,127,856

[45] Date of Patent: Jul. 7, 1992

[54] POWER STEERING SYSTEM FOR OUTBOARD MOTOR

[75] Inventors: Katsukuni Kabuto, Aichi; Akihisa Ikoma, Giju, both of Japan

[73] Assignee: Kayaba Industry Co. Ltd., Japan

[21] Appl. No.: 484,367

[22] Filed: Feb. 26, 1990

[51] Int. Cl.[5] ..... B63H 5/12

[52] U.S. Cl. ..... 440/60; 114/144 R; 440/62

[58] Field of Search ..... 114/144 R, 144 E; 440/53, 60, 59, 62, 58, 57, 63; 180/79.1

[56] References Cited

FOREIGN PATENT DOCUMENTS 114590 5/1989 Japan ..... 440/60

314695 12/1989 Japan ..... 440/60

*Primary Examiner*—Sherman D. Basinger

*Assistant Examiner*—Thomas J. Brahan

*Attorney, Agent, or Firm*—Steinberg & Raskin

[57] ABSTRACT

A power steering system for an outboard motor capable of permitting an electric motor to be driven only when the driving of the electric motor is required and automatically controlling the steering force of a steering wheel depending upon the steering reaction force. The system is so constructed that a steering cable is moved depending upon the rotation of the steering wheel and the movement of the steering cable is detected by means of a steering force sensor, which supplies a signal to a controller. The controller controls the output of the electric motor depending upon the signal.

1 Claim, 2 Drawing Sheets

POWER STEERING SYSTEM FOR OUTBOARD MOTOR

BACKGROUND OF THE INVENTION

This invention relates to a power steering system for an outboard motor mounted on a boat, and more particularly to a power steering system for an outboard motor which is adapted to carry out the power steering of an outboard motor having an engine mounted thereon while power-assisting it by means of an electric motor.

A conventional power steering system for an outboard motor having an engine mounted thereon which has been widely known in the art is disclosed in U.S. Pat. No. 4,419.084 issued to Borst on Dec. 6, 1983.

The conventional power steering system disclosed includes a drive wheel connected to an electric motor and a driven wheel arranged in a manner to be perpendicular to a plane of the drive wheel and constantly in contact with the drive wheel. The driven wheel is arranged in a manner to be movable in the radial direction of the drive wheel, as well as movable in the above-described radial direction depending upon the angle of rotation of a steering wheel. However, the driven wheel is adapted to be contacted with the center of the drive wheel when the steering wheel is at a neutral position. Thus, when the driven wheel is in this situation, it is prevented from being rotated irrespective of the rotation of the drive wheel.

Also, the conventional power steering system includes an input shaft for supporting the driven wheel, which is connected through a gear box to a threaded rod. This causes the rotation of the input shaft due to the rotation of the driven wheel to rotate the threaded wheel. The steering angle of the outboard motor is determined depending upon the so-determined number of rotations of the threaded rod.

In the conventional power steering system constructed as described above, the rotation of the steering wheel causes the input shaft to be moved in the axial direction thereof depending upon the steering power of the steering wheel, as well as the driven wheel to be moved in the radial direction of the drive wheel, resulting in the driven wheel being offset. The amount or magnitude of offset of the driven wheel is proportional to the steering power of the steering wheel.

When the driven wheel is thus offset with respect to the drive wheel, the rotation of the drive wheel is transmitted to the driven wheel, so that an outboard motor may be steered. An increase in steering force of the steering wheel causes the amount of offset of the driven wheel to be increased correspondingly, resulting in the number of revolutions of the driven wheel being increased even when the number of revolutions of the electric motor is kept constant. In other words, this causes the steering speed of the outboard motor to be increased correspondingly.

Unfortunately, the conventional steering system lacks a control mechanism for controlling the electric motor, resulting in the electric motor having to be continuously driven so far as the operation of the steering system is continued. Also, when the amount of offset of the driven wheel is zero, only the drive wheel is rotated while the drive wheel and driven wheel are kept in contact with each other. This causes both wheels to be highly worn. An increase in wear of both wheels prevents the rotation of the drive wheel from being accurately transmitted to the driven wheel, so that the steering performance of the steering system greatly deteriorates.

In addition, the conventional power steering system fails to vary the steering force depending upon the amount or magnitude of steering reaction force, resulting in a failure in controlling the steering force so as to correspond to the steering reaction force.

Further, the conventional power steering system is complicated in the structure of its transmission mechanism for operatively connecting the steering wheel to the final output mechanism and in the large number of parts required for the transmission mechanism, thereby causing the loss of power transmission and the cost of the system to be increased, leading to deterioration of the reliability of the system.

SUMMARY OF THE INVENTION

The present invention has been designed to obviate the aforementioned disadvantages of the prior art.

Accordingly, it is an object of the present invention to provide a power steering system for an outboard motor which is capable of permitting an electric motor to be driven only when driving is required.

It is another object of the present invention to provide a power steering system for an outboard motor which is capable of highly reducing the time of contact between a drive wheel and a driven wheel.

It is a further object of the present invention to provide a power steering system for an outboard motor which is capable of automatically controlling the steering force of a steering wheel depending upon the steering reaction force.

In accordance with the present invention, a power steering system for an outboard motor is provided. The power steering system of the present invention includes a steering wheel, a steering cable movable with the rotation of the steering wheel, a link member operatively connected through the steering cable to the steering wheel and an oscillation lever oscillated with the movement of the link member to pivotally move an outboard motor. The system is featured in that it comprises a gear case, a rack member arranged in the gear case so as to be movable in the axial direction thereof, a pinion engaged with the rack member, an electric motor for rotating the pinion, a reducing mechanism arranged between the pinion and the electric motor so as to operatively connect the pinion and electric motor to each other, a steering force sensor for detecting the steering force of the steering wheel transmitted through the steering cable to output a signal depending upon the transmitted force, and a controller for outputting a control signal for the electric motor depending upon the signal output from the steering force sensor.

BRIEF DESCRIPTION OF THE DRAWINGS

These and other objects and many of the attendant advantages of the present invention will be readily appreciated as it becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Figure 1:
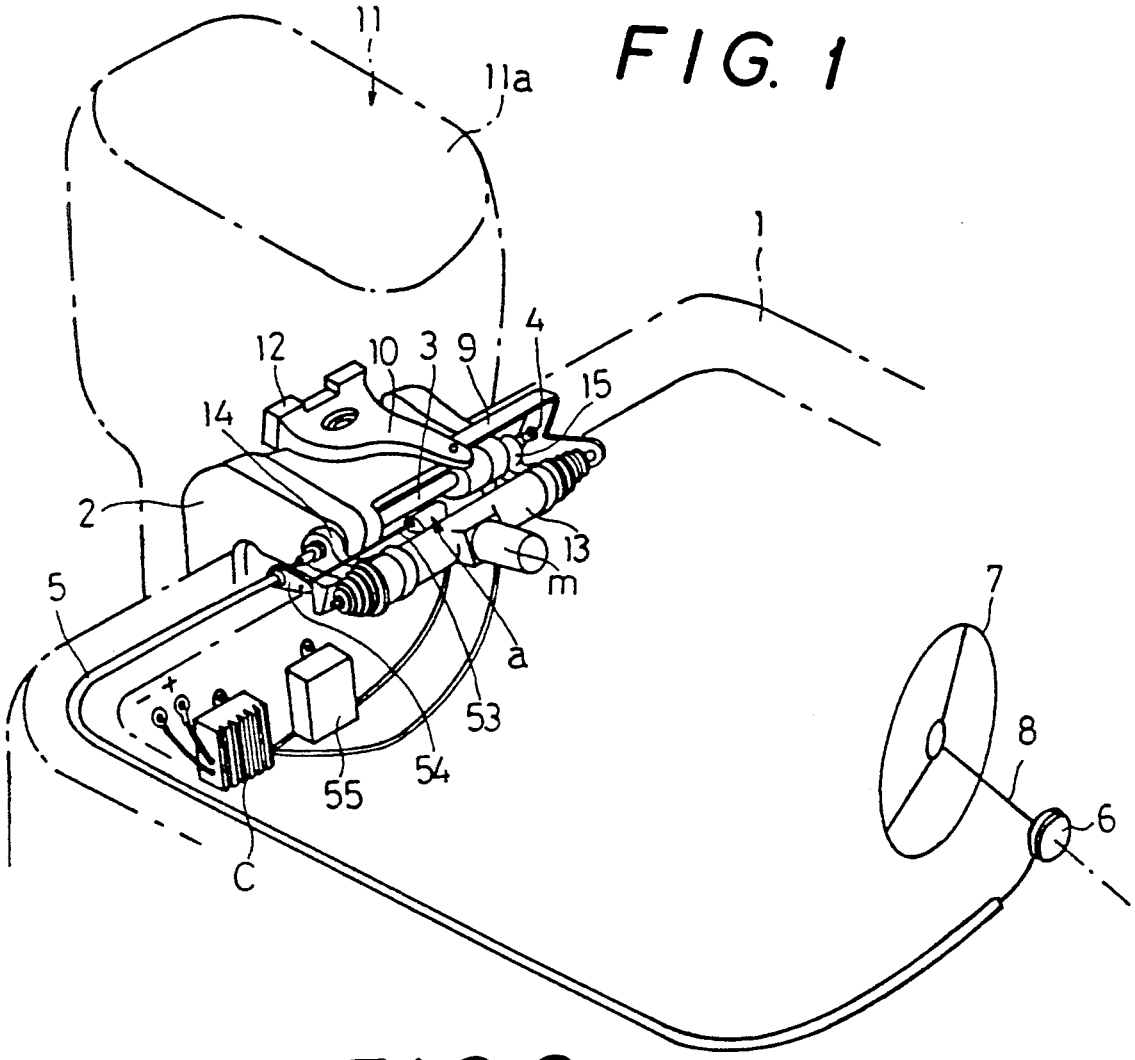
FIG. 1 is a fragmentary perspective view showing an essential part of an embodiment of a power steering system for an outboard motor according to the present invention.
Figure 2:
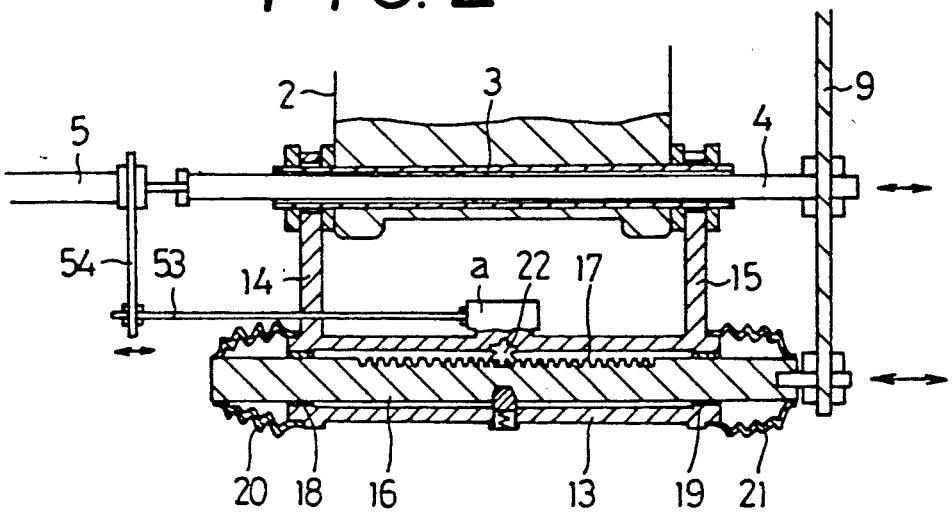
FIG. 2 is a fragmentary sectional view showing the relationship between a rack member and a slide member in the power steering system shown in FIG. 1.

Now, a power steering system for an outboard motor according to the present invention will be described hereinafter with reference to the accompanying drawings.

FIGS. 1 to 4 show an embodiment of a power steering system for an outboard motor according to the present invention. Reference numeral 1 designates a hull of a boat, on the stern of which a bracket 2 is fixedly mounted. On the bracket 2 is fixed a guide member 3 of a cylindrical shape, which is arranged to be substantially parallel with the edge of the stern. In the guide member 3 is slidably arranged a slide member 4, which is connected at one end thereof to one end of a steering cable 5. The steering cable 5 is adapted to be wound on a winding member 6. Reference numerals 7 and 8 designate a steering wheel and a revolving shaft connected at the proximal end thereof to the steering wheel 7, respectively. The winding member 6 is mounted on the distal end of the revolving shaft 8. To the other end of the slide member 4 is connected a link member 9, and on the bracket 2 is pivotally mounted an oscillation lever 10. The link member 9 is pivotally connected at the distal end thereof to the distal end of the oscillation lever 10. On the stern of the hull 1 is pivotally mounted an outboard motor 11, which is provided with a bracket 12. The above-described oscillation lever 10 is fixedly mounted on the bracket 12 of the outboard motor 11. The outboard motor 11 thus mounted on the stern is so arranged that a section 11*a* thereof on which an engine is mounted is positioned above the surface of the water and its screw propeller section (not shown) is positioned in the water.

The power steering system of the illustrated embodiment also includes a gear case 13 of a cylindrical shape, on both sides of which mounting members 14 and 15 are mounted. The mounting members 14 and 15 each are fixed at the distal end thereof on each of both sides of the bracket 2, so that the gear case 13 may be arranged in substantially parallel with the guide member 3. The gear case 13 is provided on both ends thereof with bearings 18 and 19, through which a rack member 16 is slidably supported in the gear case 13. The rack member 16 is arranged in such a manner that both ends thereof are projected from the gear case 13. On one end of the rack member 16 is fixed the distal end of the link member 9. Such construction permits the movement of the rack member 16 in the axial direction thereof to pivotally move the link member 9, resulting in the oscillation lever 10 being oscillated in such a manner as described above. Reference numerals 20 and 21 each designate a boot provided so as to cover each of the exposed ends of the rack member 16. The boots 20 and 21 act to prevent foreign matter such as dust or the like from entering the gear case 13.

Figure 3:
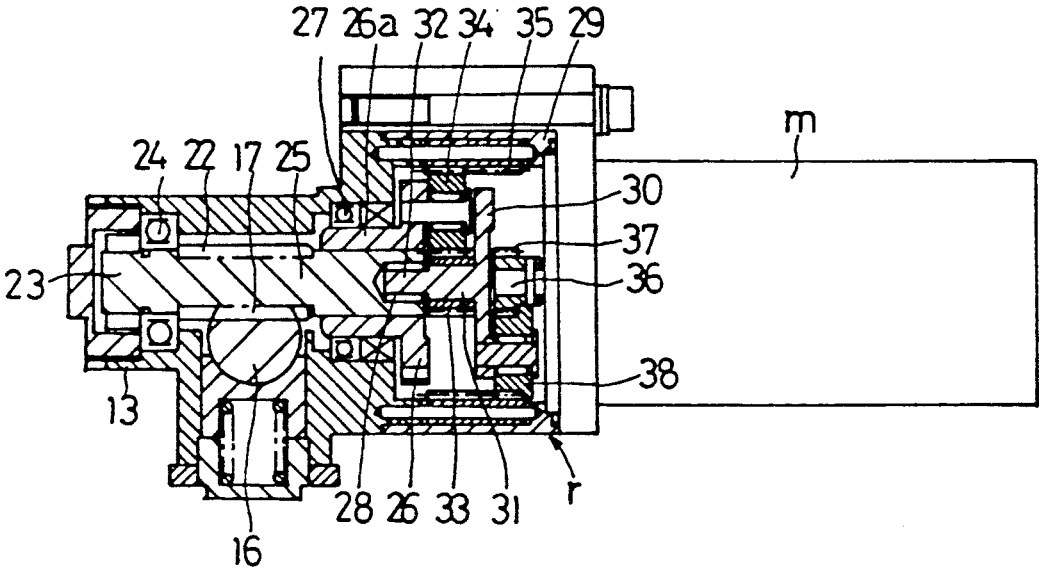
FIG. 3 is a sectional view showing the relationship between a speed reducer and a slide member in the power steering system shown in FIG. 1.

The gear case 13, as more clearly shown in FIG. 3, is provided therein with a pinion 22 having support shafts 23 and 25 mounted on both sides thereof. One support shaft 23 of the pinion 22 is supported in the gear case 13 through a bearing 24 arranged in the gear case 13.

On the other support shaft 25 of the pinion 22 is fittedly mounted a first carrier 26, which includes a cylinder 26*a* rotatably supported in the gear case 13 through a bearing 27 arranged in the gear case 13. The other support shaft 25 is provided at the distal end thereof with a bearing 28 in a manner to be fitted therein.

Designated as reference character r in FIG. 3 is a speed reducer serving to operatively connect the pinion 22 and an electric motor m to each other. The speed reducer r includes a casing 29 and the shaft 25 of the pinion 22 is so arranged that its distal end extends into the casing 29. Reference numeral 30 designates a second carrier which is formed on the substantially central portion thereof with a projection 31 serving as a revolving shaft. The revolving shaft 31 is further outwardly projected at the distal end thereof so as to provide a support shaft 32, which is inserted into the bearing 28 so that the second carrier 30 may be rotatably supported in the casing 29.

On the revolving shaft 31 is fittedly mounted a first sun gear 33 and on the first carrier 26 is rotatably mounted a first planet gear 34. Also, in the inner periphery of the casing 29 is securely fitted a ring gear 35. The first planet gear 34 is concurrently engaged with the first gear sun gear 33 and ring gear 35. Such construction results in the rotation of the first sun gear 33 causing the first planet gear 34 to revolve round the first sun gear 33 while revolving on its axis, so that the first carrier 26 may be rotated.

The electric motor m includes an output shaft 36, on which a second sun gear 37 is fittedly mounted. The second carrier 30 is provided with a second planet gear 38, which is concurrently engaged with the sun gear 37 and ring gear 35. The rotation of the first sun gear due to driving of the electric motor m causes the second planet gear 34 to revolve round the second sun gear 37 while revolving on its axis, resulting in rotating the second carrier 30.

Figure 4:
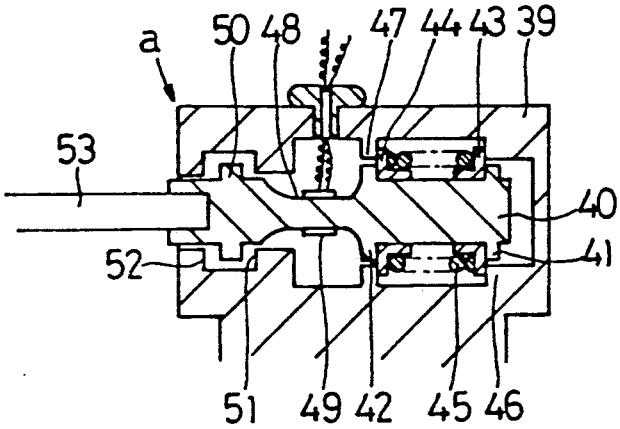
FIG. 4 is a sectional view showing a steering force sensor for detecting a steering force.

Designated generally by reference character a in FIG. 4 is a steering force sensor arranged contiguous to the casing 13, which includes a housing 39 and a sensor body 40 received in the housing 39. The sensor body 40 is formed at one end thereof or a right end thereof in FIG. 4 with a first flange 41. Also, the sensor body 40 is formed at the intermediate portion thereof with a second flange 42 in a manner to be inwardly spaced by a predetermined interval in the axial direction thereof from the first flange 41. Between the so-positioned first and second flanges 41 and 42 are slidably arranged spring seats 43 and 44, between which a spring 45 is interposed. The spring seats 43 and 44 are formed into an outer diameter sufficient to be abuttingly engaged with stoppers 46 and 47 formed on the inner surface of the housing 39 as well as the flanges 41 and 42, respectively.

The sensor body 40 is also formed with a reduced-diameter section 48. In the illustrated embodiment, the reduced-diameter section 48 is provided inside the second flange 42 in a manner to be contiguous thereto. On the reduced-diameter section 48 is mounted a strain gage 49, which is connected to a controller C provided on the hull 1 as shown in FIG. 1. Also, the sensor body 40 is provided on the portion thereof contiguous to the reduced-diameter section 48 with an annular projection 50 radially extending therefrom so as to function as a stopper. Thus, in the illustrated embodiment, the reduced-diameter section 48 is arranged in a manner to be interposed between the second flange 42 and the stopper 50. The annular projection 50 is movable between steps 51 and 52 which are formed on the inner surface of the housing 39 in a manner to be spaced by a predetermined distance from each other in the axial direction thereof.

The so-constructed sensor body 40 is connected at the outer end thereof to one end of a transmission rod 53, of which the other end is fixedly connected to a coupling element 54 provided at the steering cable 5 as shown in FIG. 1.

Reference numeral 55 (FIG. 1) designates a driver connected to the controller C.

Now, the manner of operation of the power steering system of the illustrated embodiment constructed as described above will be described hereinafter.

When the steering wheel 7 is rotated, the steering force of the steering wheel 7 is transmitted through the steering cable 5, slide member 4, link member 9 and oscillation lever 10 to the outboard motor 11. Also, the steering force is transmitted through the coupling element 54 and transmission rod 53 to the sensor body 40 as well. This causes the sensor body 40 to be pulled against or pushed by the spring 45, resulting in strain being produced at the reduced-diameter section 48. The so-produced strain is detected by the strain gage 49 of the steering force sensor a, which then supplies a detection signal to the controller C depending upon the detection.

The controller C the amount of steering force to be power-assisted depending upon the detection signal supplied thereto from the strain gage 49 of the steering force sensor a, resulting in the generating of an operation signal, and controls the output of the electric motor m and the direction of rotation of the electric motor m depending upon the operation signal.

When the electric motor m is driven by the controller C so as to generate the so-controlled output, the second sun gear 37 is rotated together with the output shaft 36. The rotation of the second sun gear 37 causes the second planet gear 38 to revolve round the second sun gear 37 while revolving on its axis, resulting in the second carrier 30 being rotated. The rotation of the second carrier 30 leads to rotation of the first sun gear 33 and causes the first planet gear 34 to revolve round the first sun gear 33 while revolving on its axis, resulting in rotation of the first carrier 26 and pinion 22.

The rotation of the pinion 22 causes the rack member 16 to slide in the right or left direction depending upon the direction of rotation of the pinion 22, so that the link member 9 may be pivotally moved to oscillate the oscillating lever 10 and steer the outboard motor 11 in a desired direction.

Thus, it will be noted that the illustrated embodiment permits the steering force of the steering wheel to be power-assisted by means of the output of the electric motor m, resulting in the steering force being reduced.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A power steering system for an outboard motor mounted on a hull of a boat which steering system includes a steering wheel, a steering cable moved with the rotation of the steering wheel, a link member operatively connected through the steering cable to the steering wheel and an oscillation lever oscillated with the movement of the link member to pivotally move an outboard motor, comprising:

a gear case;

a rack member arranged in said gear case so as to be movable in the axial direction thereof;

a pinion engaged with said rack member;

an electric motor for rotating said pinion, a reducing mechanism arranged between said pinion and said electric motor so as to operatively connect said pinion and electric motor to each other;

a steering force sensor for detecting the steering force of said steering wheel transmitted through said steering cable to output a signal depending upon the transmitted force; and a controller for outputting a control signal for said electric motor, said control signal being solely depended upon said signal output from said steering force sensor.

* * * * *